US006120181A

United States Patent [19]

Wilcox

[11] Patent Number: 6,120,181

[45] Date of Patent: Sep. 19, 2000

[54] PILLOW BAG WITH INTEGRAL FILLING CONDUIT

[75] Inventor: Donald E. Wilcox, Rochester, N.Y.

[73] Assignee: A. R. Arena Products, Inc., Rochester, N.Y.

[21] Appl. No.: 09/238,338

[22] Filed: Jan. 27, 1999

Related U.S. Application Data

[60] Provisional application No. 60/072,816, Jan. 28, 1998.

[51] Int. Cl.[7] ..... B65D 30/26

[52] U.S. Cl. ..... 383/41; 383/3; 383/44; 383/109; 383/66

[58] Field of Search ..... 383/906, 3, 38, 383/41, 67, 109, 44, 66

[56] References Cited

U.S. PATENT DOCUMENTS

| | | | |
|---|---|---|---|
| Re. 32,232 | 8/1986 | Bonerb et al. . | |
| 2,333,587 | 11/1943 | Salfisberg | 383/906 X |
| 2,446,308 | 8/1948 | Smith | 383/906 X |
| 2,799,314 | 7/1957 | Dreyer et al. | 383/44 |
| 2,930,423 | 3/1960 | Cunningham et al. . | |
| 2,950,037 | 8/1960 | Orsini | 383/44 X |
| 2,951,628 | 9/1960 | Grussen | 383/906 X |
| 2,956,839 | 10/1960 | Hermanns . | |
| 3,224,640 | 12/1965 | Schneider et al. | 383/906 X |
| 3,275,197 | 9/1966 | Eklund . | |
| 3,510,142 | 5/1970 | Erke | 383/3 X |
| 3,709,426 | 1/1973 | Farkas | 383/44 X |
| 4,270,533 | 6/1981 | Andreas . | |
| 4,449,646 | 5/1984 | Bonerb et al. . | |
| 4,476,998 | 10/1984 | Bonerb et al. . | |
| 4,673,112 | 6/1987 | Bonerb . | |
| 4,796,788 | 1/1989 | Bond . | |
| 5,096,092 | 3/1992 | Devine . | |
| 5,335,820 | 8/1994 | Christianson . | |
| 5,344,048 | 9/1994 | Bonerb . | |
| 5,487,470 | 1/1996 | Pharo | 383/3 X |
| 5,489,037 | 2/1996 | Stopper . | |
| 5,494,394 | 2/1996 | Podd et al. . | |
| 5,531,361 | 7/1996 | Podd . | |
| 5,636,764 | 6/1997 | Bonerb . | |

FOREIGN PATENT DOCUMENTS

| | | | |
|---|---|---|---|
| 878672 | 11/1981 | U.S.S.R. | 383/3 |
| 794125 | 4/1958 | United Kingdom | 383/41 |
| 855804 | 12/1960 | United Kingdom | 383/44 |

*Primary Examiner*—Jes F. Pascua
*Attorney, Agent, or Firm*—Eugene Stephens & Associates

[57] ABSTRACT

Layers of material are bonded together to include portions that yield an integral filling conduit or snout in a completed single or multiple-ply bag particularly useful in bag-in-box shipping containers. The layers are bonded to form the preferred shape of a trapezoid whose long base is parallel to and runs into the top of a rectangle, the bonds forming seams on the sides of the trapezoid and the sides and base of the rectangle. Alternatively, half the number of layers can be folded and bonded to yield the trapezoid/rectangle shape, in which case no base seal is required. The trapezoid's short base is the snout opening and, where necessary, interply bonds are formed around the opening circumference. The invention can also be formed with an evacuation enhancement system that uses an inflatable air chamber in an interply region to cause more of the bag contents to be discharged than would otherwise occur. Interply bonds in two key locations form the air chamber, and an air input conduit included between the plies allows access to the interply region. In use, the filled bag's edge seals preferably lie in the corners of a rigid container with the air input conduit, when present, against a side of the container opposite the bag's drain port and connected to a source of pressurized air. As the enhanced evacuation system bag contents level drops, the air chamber inflates and urges the contents toward the drain port.

16 Claims, 4 Drawing Sheets

PILLOW BAG WITH INTEGRAL FILLING CONDUIT

This application claims the benefit of U.S. Provisional Application No. 60/072,816, filed on Jan. 28, 1998, which provisional application is incorporated by reference herein.

TECHNICAL FIELD

The invention relates to the field of bulk material shipping containers. Specifically, the invention relates to so-called pillow bags.

BACKGROUND OF THE INVENTION

Bulk material shippers who do not want to or cannot pump their bulk material typically have two options: open top bags and snout bags, both of which allow the bulk material to be poured into the bags. As between these two types of bags, these bulk material shippers prefer snout bags because they have less material to tie off when they are to be closed than open top bags. However, the only snout bags currently available are of the fitted bag type, and the equipment used to make fitted bags and the process by which fitted bags are made cause them to be expensive.

Pillow bags are widely used in the bulk material shipping industry because they are easy to use and inexpensive. However, because of the nature of their construction, pillow bags lack a filling conduit or snout as found on snout bags that would enhance ease of filling the bags for certain applications, especially where the bulk material is poured instead of pumped. Prior attempts to incorporate snouts into pillow-type bags have failed for one reason or another. As a result, many bulk material shippers turn to fitted bags with snouts because they are easier to fill even though they are more expensive. Consequently, there is a need for a new pillow-type bag that includes a snout for easy filling of the bag.

SUMMARY OF THE INVENTION

I have found a way to include a snout on a pillow bag without significantly increasing cost or difficulty of manufacture. In one embodiment, using a single-ply bag as an example, I take two rectangular layers of material and bond their edges into a shape that will yield a bag with a snout, such as a rectangle with the long base of a trapezoid on one side. Flaps of material are left next to the sides of the trapezoid, and I cut these off to facilitate handling and filling of the bag. Alternatively, I can use one rectangular layer of material folded in half, then bond its edges along the sides to form the same trapezoid/rectangle shape. In this alternative, the fold lies on the side of the rectangle opposite the long base of the trapezoid and may not need to be sealed, depending on the particular application and the desires of the user. A drain can be included in one side of either variation of the bag to allow discharge of the bag's contents.

With the bag thus sealed, it is ready for use. I prefer to mount the bag on a cassette that allows easy manipulation of the bag and substantially prevents folds of the bag from becoming trapped beneath the bulk material, which could reduce the amount of bulk material shipped and put undesirable strain on the bag. I position the bag in a rigid container, such as a plastic shipping tote, so that the seams lie at the midpoints of opposing sides of the container. Alternatively, I can position the bag so that the seams lie in the corners of the tote, depending on the particular needs of the user. The position of the sea ms must be taken into account when making the bag, however, to ensure adequate material for proper sizing of the bag. With the bag positioned as desired, I then attach the snout to a source of bulk material, preferably using a spanner bar, and fill the bag. When the bag is full, I remove the snout from the spanner bar (if used), tie it off, and ship it. My invention thus provides a much less costly snout bag than prior art arrangements.

In an additional embodiment where the bag includes a drain port and at least two adjacent plies when filled, I use the plies of the bag to form an inflatable air chamber that extends down a side of the bag opposite the drain port and under the contents along the bottom of the bag. Prior to discharge of the contents of the bag, I connect the air chamber to a source of pressurized air via an air input port formed between two of the plies. As the contents of the bag are evacuated, the air enters the inflatable chamber, expanding it so that the contents are pushed toward the drain port. As the level of the contents decreases the inner ply of the side wall advances toward the drain port while lifting up, which pulls the lower portion of the side wall up and pulls portions of the inner ply that were on the bottom up to become part of the side wall. This action keeps the level of the contents above the drain port. Bag material that collects as a result of the emptying of the bag rides or floats on the surface of the bulk material until the level of the bag contents falls below the top of the drain port, at which point the bag material can be sucked against the drain port, preventing further evacuation of the bag contents. However, the blockage occurs much later with my invention than with prior bags. An additional feature of this variation of my invention is that the inflating chamber pulls bag material that would collect on the surface of the bulk material taut, further delaying, if not preventing, blockage of the drain port.

In the inflatable variation of my snout bag, I prefer to form seals between the plies of the bag: one along the side(s) of the bag opposite the drain port and one along the side(s) including (and nearest to) the drain port. The seal opposite the drain port is preferably formed about three-quarters of the way up the side of the bag below the snout, though the exact position can vary depending on the particular application. The other seal is at the midpoint of the bag. The air input port is formed just below the seal opposite the drain. The result of this configuration is a minimization of material left in the bag when no more material can be discharged. This can result in a significant increase in the amount of material evacuated from the bag, saving the user material, time, and money.

Thus configured, my bag and system can be used in any bag-in-rigid-container bulk material shipping system using a bag with at least two plies and a drain port in, at, or near the bottom of the container. The evacuation enhancement aspect of my system does not employ external bladders, tilting bottoms, stiffening battens, or an external structure to bolster a shipper in a high-pressure system as do prior art devices. Instead, I take advantage of the structure of the bags to form an inflatable air chamber between the plies of the bag using edge and other seals, bonds, or seams, the air chamber extending beneath so me or all of the contents of the bag. I apply only enough pressure to allow gravity to move the bulk material, whereas prior art devices apply pressure in such ways and at sufficient levels to forcefully evacuate the bulk material. My invention can be used with liquids, powders, pastes, or any other suitable bulk materials.

DESCRIPTION OF THE INVENTION

DESCRIPTION OF THE INVENTION

Figure 1:
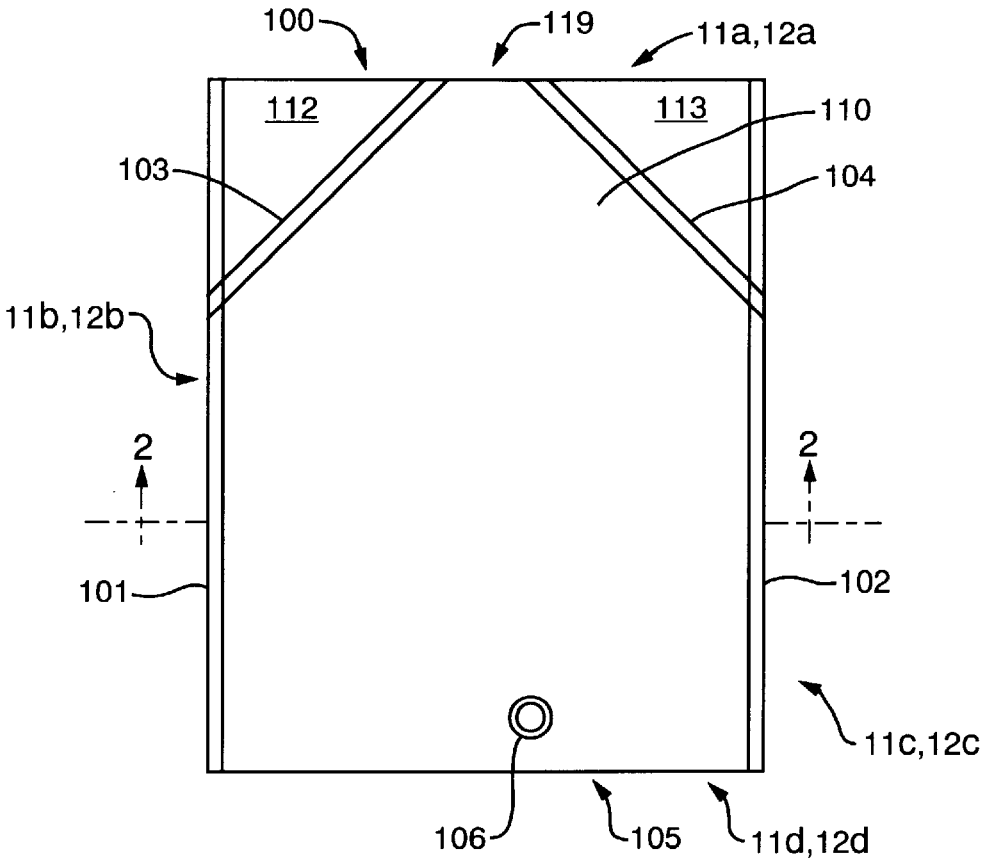
FIG. 1 is a schematic front view of a pillow bag with an integral fill conduit according to an aspect of the invention.
Figure 2:
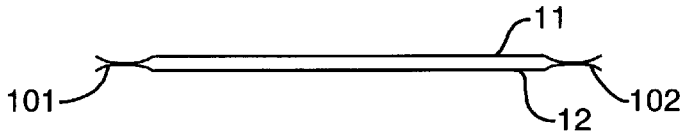
FIG. 2 is a cross sectional schematic view of a single-ply version of the invention of the type shown in FIG. 1 taken along the line 2—2.
Figure 3:
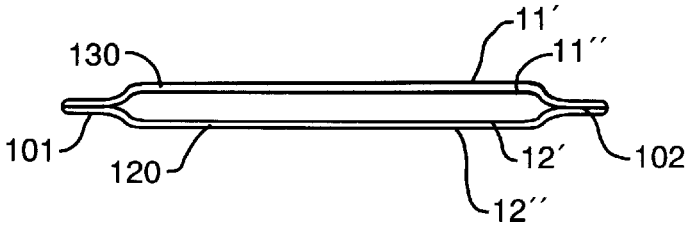
FIG. 3 is a cross-sectional schematic view of a multiple-ply version of the invention of the type shown in FIG. 7 taken along the line 3—3 or of the type shown in FIG. 1 taken along the line 2—2.
Figure 4:
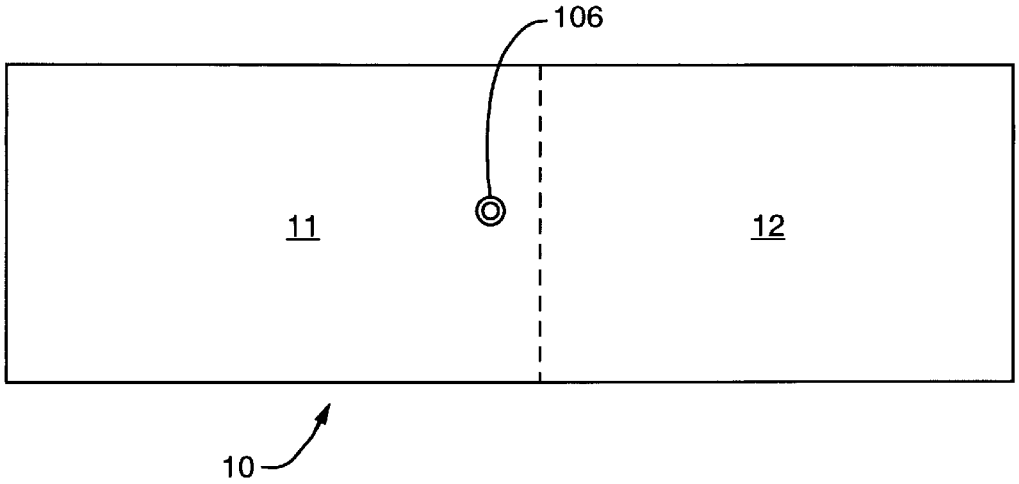
FIG. 4 is top schematic view of a piece of material used to form the invention.
Figure 5:
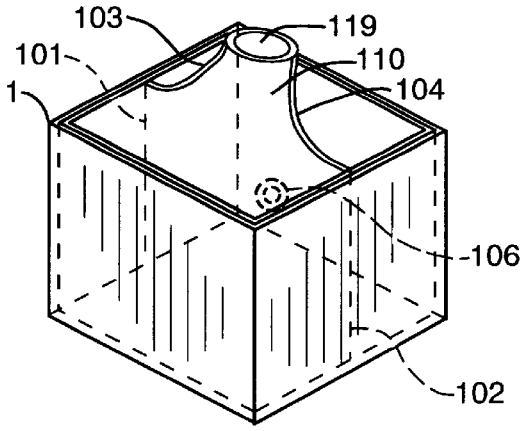
FIG. 5 is a schematic elevational view of the invention filled and arranged in a rigid container according to an aspect of the invention.
Figure 6:
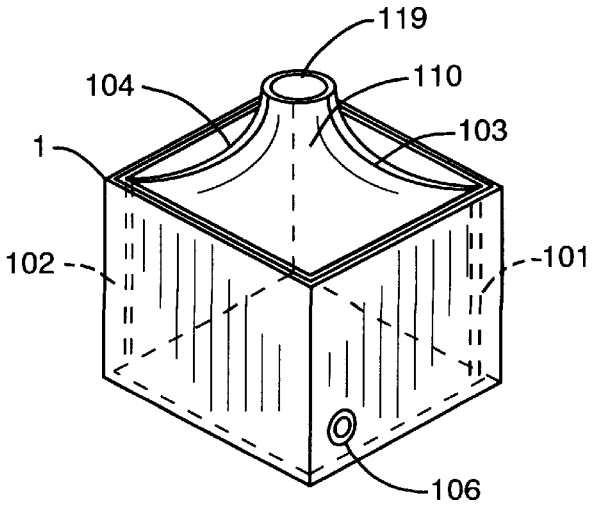
FIG. 6 is a schematic elevational view of the invention filled and arranged in a rigid container according to another aspect of the invention.

With reference to the accompanying Figures, to form my new bag 100 in its most basic form, I prefer to fold a single, rectangular piece of material 10 to form two rectangular layers of material 11, 12, as seen in FIG. 4. I take the two layers of material 11, 12, preferably rectangular, each including a top edge 11*a*, 12*a* side edges 11*b*, 12*b*, 11*c*, 12*c* and a bottom edge 11*d*, 12*d*. I bond the layers together in a shape that will yield a bag with an integral filling conduit 110, which I prefer to call a snout, my preferred shape for the layers being a rectangle with an adjacent trapezoid. Other shapes can be used as well so long as they yield the bag with its snout. For the preferred trapezoid/rectangle arrangement, the long base of the trapezoid abuts the top of the rectangle. I bond the layers 11, 12 of material to form seams 101, 102, 105 along the left and right sides and base of the rectangle, which are the side edges 11*b*, 12*b*, 11*c*, 12*c* and bottom edges 11*d*, 12*d* of the layers. Then I bond the layers along the sides of the trapezoid to form diagonal seams 103, 104 extending from the sides of the rectangle to the short base of the trapezoid, which lies along the top edges 11*a*, 12*a* of the layers. I prefer to trim off the flaps of excess material 112, 113 left after the diagonal seams 103, 104 are formed. The top of the trapezoid is left open so that an unsealed portion 119 is left between the tops of the diagonal seams 103, 104 and is a fill opening. This yields a single-ply bag that includes its cwn filling conduit or snout 110 for easy filling of the bag 100. I prefer to form a drain or exit port 106 in one side of the bag 100, though this can be omitted if desired. I can, of course, make my bags 100 with multiple plies by adding more pairs of layers of material 11', 12', as illustrated in FIG. 3, which shows a two-ply version of my bag 100 in cross-section.

Figure 8:
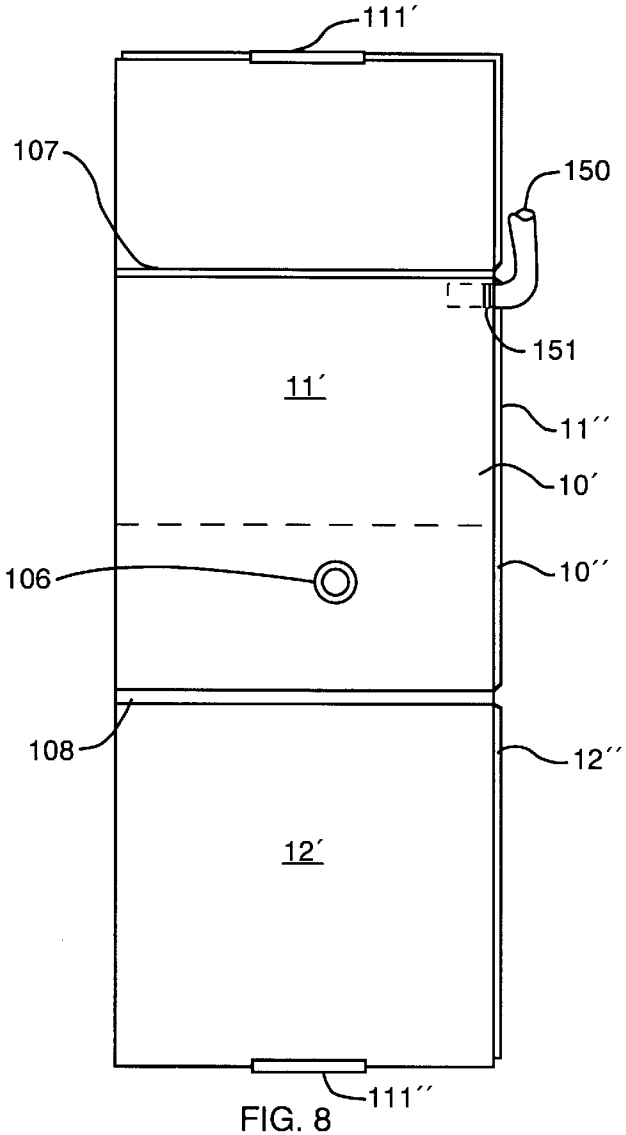
FIG. 8 is a top schematic view of two exemplary pieces of material used to form a two-ply version of the invention shown in FIG. 7.
Figure 7:
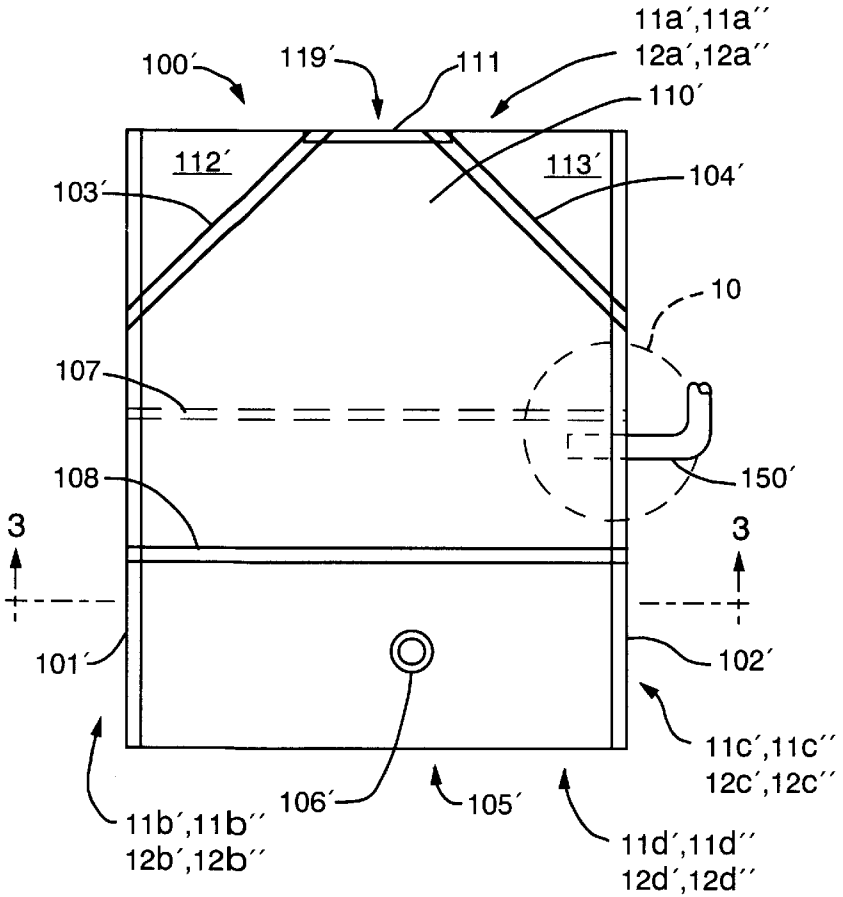
FIG. 7 is a schematic front view of a pillow bag with an integral fill conduit according to another aspect of the invention.
Figure 9:
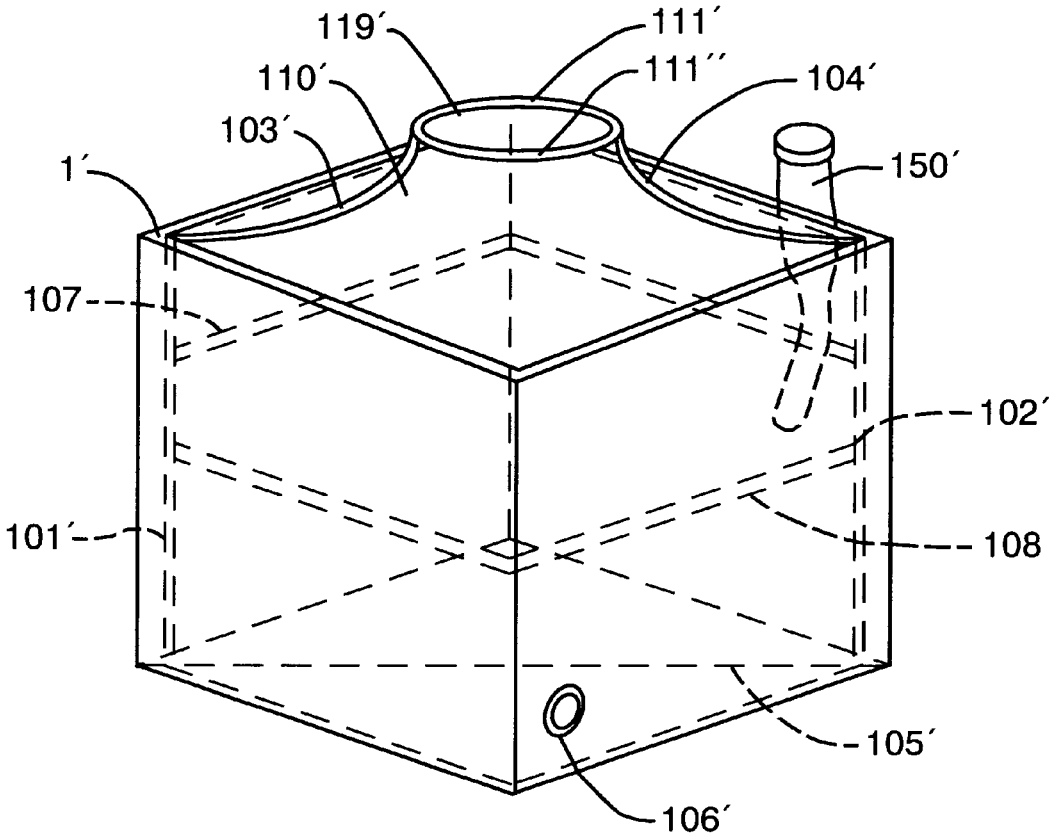
FIG. 9 is a schematic view of the bag of FIGS. 7 and 8 as it appears when filled.
Figure 10:
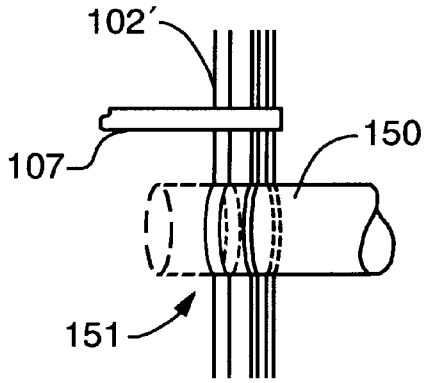
FIG. 10 is a close-up of the air input conduit of the bag of FIGS. 7–9.

As an alternative to forming the two layers of material from a single, folded piece of material, I can cut each layer 11, 12 as individual pieces of material. For bags with two or more plies, I bond the layers 11', 11", 12', 12" together along the short base of the trapezoid (a portion of the top edges 11*a*', 12*a*', 11*a*", 12*a*" which becomes the mouth of the snout 110) as seen in FIGS. 8 and 9 to form interply bonds or internal seals 111', 111". The base of the rectangle need not be sealed and 105 simply represents a fold line in this case.

To use 100, I prefer to place it in a rigid container 1, such as a plastic tote, arrange so that the drain port 106, if included, protrudes from a hole in the container 1 and so the seams 101–104 of the bag will extend up the midpoints of opposing sides of the container 1. I then connect the mouth of the snout 119 to a fill head via a spanner bar, fill the bag 100 through its snout 110, remove the bag 100 from the spanner bar, seal the snout, and ship the filled bag 100 in its rigid container 1. The positioning and filling could also be done using a cassette to hold the bag 100 during insertion and filling. The cassette is configured to hold the bag 100 as it fills so that a minimum of folds of bag material are trapped under the bulk material during filling, which could reduce the shipped amount of bulk material and put undesirable strain on the bag. The cassette is typically made of an inexpensive, lightweight material, such as cardboard.

I can also make my bag so that I can inflate interply regions of the bag for enhanced bag evacuation. In this case, the simplest form is a two-ply bag. Closed bulk material shipper bags commonly include at least two edge seals (heat seal, tie off, or other type) on opposite sides or ends of the bag. Optionally, they can have a seal around the full perimeter of the bag. In my case, I form seals down the edges of the layers of material used to make the bag. I add a third seal to connect the two edge seals, if such a third seal is not already present. This third seal can be another edge seal or an internal seal or interply bond through the plies on one side of the bag. Preferably, the seal should be placed roughly opposite the drain port at a point at which the amount of bag material leading to the drain on either side of the seal is substantially equal, though the exact position can vary depending on the particular application. The third seal should also be somewhere above the floor of the container, preferably at or above the midplane of the container.

A fourth seal completes an inflatable air chamber in the interply region, and I add a fourth seal if it is not already present. One way to form the fourth seal is to use the weight of the bag contents, such as by placing the fold on the bottom of the container, so that the contents hold the plies together in a quasi-seal. Alternatively, a physical seal can be formed connecting the two edge seals positioned under the contents or on the opposite side of the contents from the third seal. Other seals can also be employed, or the seals can be combined into one or more continuous seals, but the four seals discussed above are the minimum required. The connection to the air chamber can be made at any point in the air chamber, but the air chamber inflates sooner and grows larger if the connection is made higher in the container.

In my exemplary embodiment of an evacuation enhanced snout bag 100', referring in particular to FIGS. 3 and 7–10, I prefer to fold two rectangular pieces of material 10', 10" to form four rectangular layers of material 11', 11", 12', 12". I p this case, the base of the rectangle need not be sealed and 105' simply represents a fold line. I then take the two back layers 11', 11" and bond them together to form a back interlayer or interply bond 107, which is the equivalent of the third seal mentioned above, as well as the back snout interlayer Bond 111' along a portion of the top edges 11*a*', 11*a*" of the back layers. I also insert an air input conduit 150 between the back layers 11', 11" to allow access to a rear interply region 120 between the back layers 11', 11" as seen particularly in FIG. 10. Next I take the two front layers 12', 12" and bond them together to form a front interlayer or interply bond 108, which is the equivalent of the fourth seal mentioned above, as well as the front snout interlayer bond 111" along a portion of the top edges 12*a*', 12*a*" of the front layers. I then bond all four layers 11', 11", 12', 12" together along side edges 11*b*', 11*b*", 12*b*', 12*b*", 11*c*', 11*c*", 12*c*', 12*c*" to form the sides and base of the rectangle and the sides of the trapezoid with seams or seals 101', 102', 103', 104', 105'. I form the drain port in the front layers. Here, as above, I can cut the four layers individual pieces of material rather than forming them from two folded pieces of material.

The back and front interply bonds 107, 108, along with the side seams 101'–104', define an inflatable air chamber in the rear and front interply regions 120, 130. The air chamber extends from the back interply bond 107 down the side of the bag 100', under the contents of the filled bag 100', and up the opposite side of the bag 100' to the front interply bond 108. When a user is ready to discharge the contents of the filled bag 100', he or she connects the air input conduit 150 to a source of pressurized air. As the contents of the bag 100' are discharged, the air chamber inflates, expanding the interply regions 120, 130. The inflation of the air chamber pulls up on the inner ply 11", 12" along the side and bottom of the bag 100'.

Here as shown particularly in FIG. 9, I prefer to arrange the bag 100'with the edge seams 101', 102' in the corners of the rigid container 1', the diagonal seams 103', 104' extending from the top corners toward the center of the bag 100', and the drain port 106' protruding from a hole in the rigid container 1'. Once the bag 100' is filled, the air input conduit 150 runs up between the side of the bag 100' and the side of the container 1' and over the edge of the container 1'.

Prior to discharge of the bag contents, I connect the air chamber to a source of low pressure air just sufficient to lift the contents (preferably less than one psig for a typical intermediate bulk container of the 300 gallon range). During discharge of the contents, the inner ply 11', 12' of the air chamber moves the content to the drain 106 so that the bag 100 is completely or nearly completely evacuated without human attendance. The air expands the air chamber until a force balance is reached with the weight of the fluid (this can also be expressed as a pressure balance between air pressure and fluid pressure on he inner ply). Since the air chamber extends down the wall of the container and under the fluid, it pushes the fluid away from the wall as it inflates. As the volume of the bag contents diminishes, the air chamber continues to expand by inflation.

The air chamber and the bag are configured so that the air chamber expands to the greatest extent in a region of the container away from the drain, thus forcing he contents toward the drain. As the chamber expands, the increased area on which the air pressure acts increases the force exerted on the fluid by the inner ply(ies) of the bag. The force reaches a maximum when the bag is nearly completely evacuated, at which point the bag material would normally obstruct the drain. However, the fluid at the drain floats adjacent bag material above the drain, preventing the bag material from blocking the drain and trapping fluid in the bag. Additionally, the inflation of the air chamber pulls the bag material taut so that the drain remains unobstructed.

The drain fitting is locked in the container and seals through the bag plies. This anchors or ties the bag down at one point in, at, or near the floor of the container. This also limits the inflation of the air chamber at and around the drain port. The air chamber is also configured so that its expansion pulls the layers of the bag taut. When the volume of fluid left in the bag is insufficient to float the bag material above the drain, this tension prevents the bag material from closing off the drain. The air chamber is optimally configured so that, near the end of evacuation, all the remaining fluid is lifted off the floor of the container, above the level of the drain. This allows the fluid to flow down into the drain as if it were in a funnel. The fluid can be used as a fourth quasi-seal. If the fluid is used as a fourth quasi-seal, then air seeps under the fluid and expands into chambers on both sides of the fluid formed in the main air chamber by the presence of the fluid. This action enhances the evacuation by pulling the bag layer in from the of drain up at an angle. This angle provides a gap for flow of the remaining fluid to the drain port.

Parts List

| | |
|---|---|
| 1, 1' | Rigid Container |
| 10, 10', 10" | Piece(s) of material |
| 11, 11', 11" | Back layer(s) of material; back ply(ies) |
| 11a, 11a', 11a" | Top edge of back layer(s) of material/back ply(ies) |
| 11b, 11b', 11b" | Side edge of back layer(s) of material/back ply(ies) |
| 11c, 11c', 11c" | Side edge of baok layer(s) of material/back ply(ies) |
| 11d, 11d', 11d" | Bottom edge of back layer(s) of material/back ply(ies) |
| 12, 12', 12" | Front layer(s) of material; front ply(ies) |
| 12a, 12a', 12a" | Top edge of front layer(s) of material/front ply(ies) |
| 12b, 12b', 12b" | Side edge of front layer(s) of material/front ply(ies) |
| 12c, 12c', 12c" | Side edge of front layer(s) of material/front ply(ies) |
| 12d, 12d', 12d" | Bottom edge of front layer(s) of material/front ply(ies) |
| 100 | Snout bag; pillow bag with integral fill conduit |
| 100' | Evacuation-enhanced snout bag; evacuation enhanced pillow bag with integral fill conduit |
| 101, 101' | First main seam |
| 102, 102' | Second main seam |
| 103, 103' | First diagonal seam |
| 104, 104' | Second diagonal seam |
| 105, 105' | Fold line; third main seam |
| 106, 106' | Drain port; exit port |
| 107 | Fourth seam; back interlayer bond; back interply bond |
| 108 | Fifth seam; front interlayer bond; front interply bond |
| 110, 110' | Snout/integral filling conduit |
| 111 | Sealed edge of snout |
| 111' | Back interlayer bond of snout; back interply bond of snout |
| 111" | Front interlayer bond of snout; front interply bond of snout |
| 112, 112' | Flap of excess material |
| 113, 113' | Flap of excess material |
| 119, 119' | Unsealed portion of top edges; fill opening of snout bag; mouth of snout |
| 120 | Rear interply region |
| 130 | Front interply region |
| 150 | Air input conduit |
| 151 | Bond between plies of air input conduit |

I claim:

1. A pillow bag with an integral filling conduit, the pillow bag including at least four layers of bag material bonded along edges thereof an between side and top edges of the layers to form seams defining the bag the filling conduit in at least two plies, the filling conduit thereby being integrally formed from the same layers of material that form the pillow bag, the pillow bag further including an interply region between two plies, a drain port in a lower portion of the bag, and an air input port in an opposite side of the bag from the drain port, the air input port being connectable to a source of low pressure air such that low pressure air can be pumped into the interply region when the bag is full, the interply region thereby inflating and urging contents of the bag toward the drain port of the bag to enhance evacuation of the bag.

2. The pillow bag of claim 1 wherein the two layers of bag material are formed from a single piece of bag material that is folded in half.

3. The pillow bag of claim 1 wherein the two layers of material are individual pieces of material that are cut in substantially identical shapes and stacked so that edges of the layers are substantially aligned.

4. The pillow bag of claim 1 wherein a shape of each layer when laid flat includes a bag portion and an integral filling conduit portion.

5. The pillow bag of claim 4 wherein the bag portion of each layer is rectangular.

6. The pillow bag of claim 4 wherein the integral filling conduit portion of the bag is substantially in the shape of a trapezoid, a larger base of the trapezoid of each layer being substantially adjacent the bag portion of the layer.

7. A pillow bag of at least two plies formed from layers of bag material and including:

diagonal seams defining side edges of an integral filling conduit;

the diagonal seams extending from top edges of the layers of bag material to side edges of the layers of bag material;

the diagonal seams being regions of the layers of bag material that are bonded together;

side seams extending from bottom edges of layers of bag material to the top edges of the layers;

the side seams intersecting the diagonal seams;

the side seams being regions of the layers of bag material that are bonded to each other;

bottom edges of the layers of bag material joined to define a bottom of the bag;

an unsealed portion of the top edges of the layers extending between tops of the diagonal seams and defining a fill opening of the integral filling conduits;

an interply region between two plies;

a drain port in a lower portion of the bag; and an air input port in an opposite side of the bag from the drain port, the air input port being connectable to a source of low pressure air such that low pressure air can be pumped into the interply region when the bag is full, the interply region thereby inflating and urging contents of the bag toward the drain port of the bag to enhance evacuation of the bag.

8. The pillow bag of claim 7 wherein two layers of bag material are formed from a single piece of bag material by folding the single piece of bag material in half and the bottom edges of the layers are joined by virtue of being part of the single piece of material at a fold line once the single piece of bag material is folded.

9. The pillow bag of claim 8 wherein the two layers of bag material are bonded along the fold line to form a bottom seam.

10. The pillow bag of claim 8 wherein the two layers of bag material are bonded along a line parallel to and adjacent the fold line.

11. The pillow bag of claim 7 wherein the layers are individual pieces of material substantially identical dimension and perimetral extent and the bottom edges are joined because they are bonded together to form a bottom seam.

12. The pillow bag of claim 7 wherein the unsealed portion of the top edges of the layers of bag material, the diagonal seams, the side seams, and the bottom edges of the layers of bag material define a shape including a trapezoid a op a rectangle when the bag is laid flat, the diagonal seams being slanted sides of the trapezoid, the unsealed portion being a smaller base of the trapezoid, and the side seams and bottom edges being sides of the rectangle.

13. The pillow bag of claim 7 wherein the layers of bag material are rectangular.

14. The pillow bag of claim 13 wherein a triangular flap of material formed between each diagonal seam and a respective nearest top corner of the bag is removed prior to use of the bag.

15. A pillow bag formed from at least four layers of material to form at least two piles of a two-ply bag including:

diagonal seams defining sided edges of an integral filling conduit;

the diagonal seams extending from top edges of the layers of bag material to side edges of the layers of bag material;

the diagonal seams being regions of the layers of bag material that are bonded together;

side seams extending from bottom edges of layers of bag material to the top edges of the layers;

the side seams intersecting the diagonal seams;

the side seams being regions of the layers of bag material that are bonded to each other;

bottom edges of the layers of bag material joined to define a bottom of the bag;

an unsealed portion of the top edges of the layers extending between tops of the diagonal seams and defining a fill opening of the integral filling conduit;

the pillow bag further including:

an interply region between the two plies;

a drain port in a lower portion of the bag; and an air input port in an opposite side of the bag from the drain port, the air input port being connectable to a source of low pressure air such that low pressure air can be pumped into the interply region when the bag is full, the interply region thereby inflating and urging contents of the bag toward the drain port of the bag to enhance evacuation of the bag.

16. The pillow bag of claim 15 wherein an interply bond is formed between the plies extending from one side seam of the bag to an opposite side seam of the bag, the interply bond thus blocking air flow in one direction in the interply region to further enhance evacuation of the bag.

* * * * *